United States Patent [19]

Smith

[11] Patent Number: 4,781,220

[45] Date of Patent: Nov. 1, 1988

[54] FAST RESPONSE SHUT-OFF VALVE

[75] Inventor: William S. Smith, Houston, Tex.

[73] Assignee: Dresser Industries, Inc., Dallas, Tex.

[21] Appl. No.: 45,935

[22] Filed: May 4, 1987

[51] Int. Cl.[4] ..... F15B 13/044

[52] U.S. Cl. ..... 137/625.65; 137/625.33; 137/625.68; 137/906; 251/129.15

[58] Field of Search ..... 91/59; 137/625.33, 625.38, 137/625.65, 625.68, 906; 173/12; 251/129.15

[56] References Cited

U.S. PATENT DOCUMENTS 2,996,078 8/1961 Freeman et al. ..... 137/625.65

4,187,884 2/1980 Loveless ..... 137/906 X 4,312,380 1/1982 Leiber et al. ..... 137/625.65 X 4,577,661 3/1986 Melrose ..... 137/625.33

*Primary Examiner*—Gerald A. Michalsky

*Attorney, Agent, or Firm*—Roy L. Van Winkle

[57] ABSTRACT

An improved fast response shut-off valve for use with pneumatic tools and the like that utilizes a solenoid for holding the valve open and utilizes fluid pressure for driving the valve closed. Further, a field suppressor may be utilized to decrease the magnetic flux strength of the solenoid coil very rapidly increasing the rapidity with which the valve can be moved from the open to closed position.

2 Claims, 1 Drawing Sheet

FAST RESPONSE SHUT-OFF VALVE

BACKGROUND OF THE INVENTION

This invention relates generally to a shut-off valve for use with pneumatic tools and the like. More particularly, but not by way of limitation, this invention relates to an improved shut-off valve for pneumatic tools and the like that moves rapidly from the open position to the closed position.

Some of the pneumatic tools used in production, such as nut runners and the like, are at least partially computer controlled. Such controls are desirable so that the product being assembled will be uniform in that, for example, equal torque will be imposed on each screw or nut inserted in a particular position. Such controls also increase production rates and quality and decrease the rejection rate of the products.

Accordingly, it has become highly desirable to provide some means of stopping the operation of pneumatic tools as close to instantaneously as possible to take advantage of the computer controls. Efforts in this direction have included the use of solenoid actuated valves in tools manufactured by several companies. In those tools, the solenoid is utilized to either open or close the valve with a spring being provided for the purpose of returning the valve to its original position. The valves have operated satisfactorily, but a faster response time is highly desirable. Accordingly, an object of this invention is to provide an improved shut-off valve for pneumatic tools and the like which is relatively simple to manufacture and easy to maintain and that has an extremely fast response time.

SUMMARY OF THE INVENTION

This invention provides a fast response shut-off valve for pneumatic tools and the like that comprises a hollow body member having an inlet and an outlet; a hollow valve member located for reciprocating movement in the body member between open and closed positions; and means for releasably holding the valve member in the open position. The hollow valve member includes an inlet port in fluid communication with the inlet in the body member in both the open and closed positions of the valve and an outlet that is aligned with and in fluid communication with the outlet in the body member in the open position of the valve member and misaligned with the outlet in the body member preventing fluid communication therebetween when the valve member is in the closed position. The valve member is biased by fluid pressure in the body member toward the closed position for rapid movement of the valve member from the open to the closed position.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
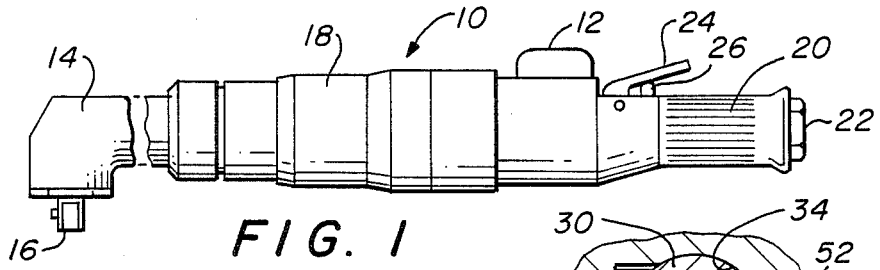
FIG. 1 is an elevation view of a pneumatically powered nut runner that includes a valve that is constructed in accordance with the invention.

Referring to the drawing and to FIG. 1 in particular, shown therein and generally designated by the reference character 10 is a pneumatically powered nut runner or driver that includes a fast response shut-off valve 12 that is constructed in accordance with the invention. The nut runner 10 includes a head 14 having a square drive 16 for use in connection with sockets or other suitable fastener tools. The head 14 is connected to a motor housing 18 that includes a pneumatically driven motor (not shown).

The motor housing 18 is also connected with a handle 20 which has a fitting 22 therein for receiving a hose (not shown) for supplying air under pressure to the nut runner 10. Also shown is a valve handle 24 that is in engagement with a plunger of a manual valve 26 (only the plunger is shown) for manually controlling the air supply to the nut runner 10.

Figure 2:
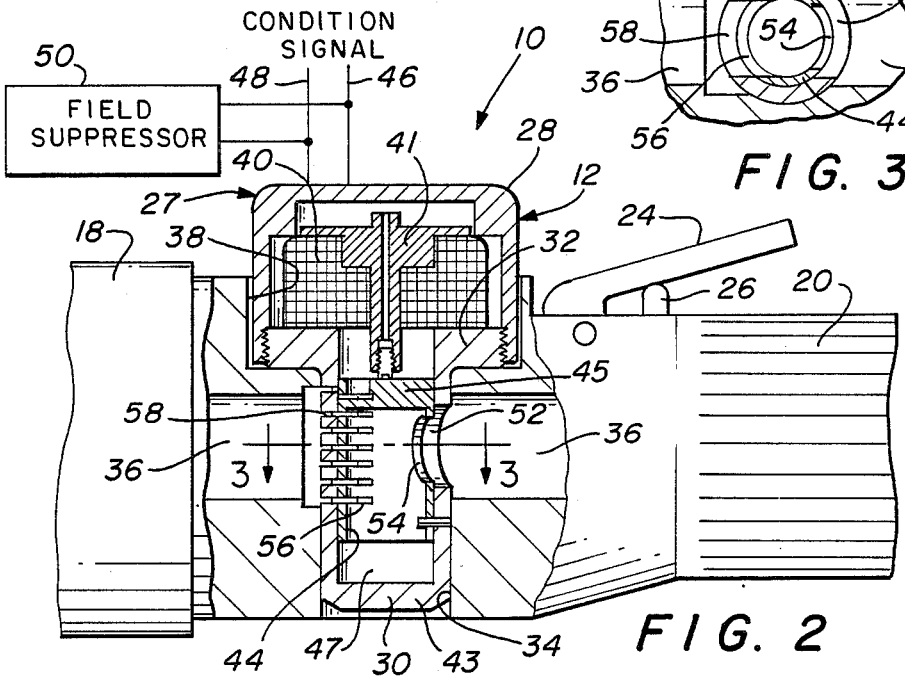
FIG. 2 is an enlarged, fragmentary view of a portion of the nut runner of FIG. 1 showing the fast response shut-off valve located therein that is constructed in accordance with the invention.

Referring to FIG. 2, the enlarged, fragmentary view of the nut runner 10 is utilized to show the structure of the solenoid actuated shut-off valve 12 in more detail. The shut-off valve 12 is shown in the open position and includes a solenoid 27 having a solenoid housing 28 that is threadedly attached to a hollow, generally cylindrical valve body member 30 at an enlarged flange 32 thereon. The solenoid actuated shut-off valve 12 is positioned in a bore 34 that extends through the nut runner 10 intersecting an air supply passageway 36 therein which receives air under pressure from the manually controlled valve 26. The passageway 36 continues on the downstream side of the valve 12 receiving pressurized air from the valve 12 and directing it to the motor (not shown) that is located in the motor housing 18.

The bore 34 has an enlarged portion 38 for receiving the flange 32 and the solenoid housing 28. It will be understood that the solenoid 27 also includes a winding or coil 40 which causes a core 41 therein to move downwardly when power is applied to the coil 40. The core 41 includes a stem 42 that engages a hollow, generally cylindrical valve member 44 which is reciprocally located within the valve body member 30. The valve body 30 and valve member 44 have closed, oppositely located ends 43 and 45, respectively, forming a variable volume chamber 47 in the valve 12.

It is only necessary in the valve 12, as designed, that the core 42 and valve member 44 move 0.050 inches from fully closed to fully open. To adjust the movement of the core 41 and valve member 44, an adjusting screw 49 is threaded into the end of the stem 42 in contact with the valve member 44.

Conductors 46 and 48 are connected to the solenoid 27 and extend to the power supply (not shown). The conductors are also connected to a sensor which generates the condition signal for actuating the solenoid 27. Illustrated schematically is a field suppressor 50 connected into the solenoid 27 in such manner that the field suppressor decreases the time required for the magnetic flux breakdown to occur in the solenoid 27 for reasons that will be apparent hereinafter.

Figure 3:
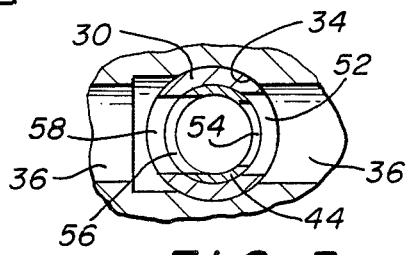
FIG. 3 is a transverse cross-sectional view taken generally along the line 3—3 of FIG. 2.

The cross-sectional view of FIG. 3 is taken along the line 3—3 of FIG. 2 and illustrates the cylindrical nature of the valve body member 30 and of the valve member 44. An inlet port 52 in the valve body and an inlet port 54 in the valve housing are illustrated as being in alignment. Since the valve 12 is in the open position as illustrated in FIGS. 2 and 3, slits 56 forming the outlet from the valve member 44 are shown as being in alignment with the slits 58 forming the outlet port through the valve body 30. This arrangement can be seen much more clearly in the enlarged views of FIGS. 4 and 5.

Figure 4:
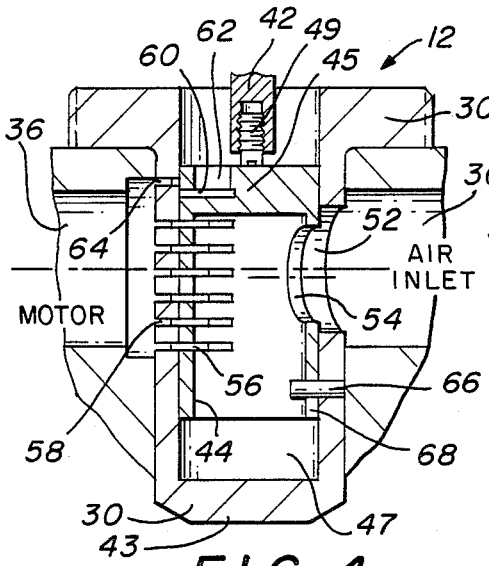
FIG. 4 is an enlarged schematic view of the valve of FIG. 2 shown in the open position.

FIG. 4 shows the valve 12 in the open position. With the valve 12 in this condition, it will be noted that a relief or vent passageway formed by a recess slit 60 and counterbore 62 is out of alignment with a vent slit 64 in the valve body 30. Thus, when the valve 12 is in the open position as illustrated in FIG. 4, pressurized air in the passageway 36 downstream of the valve 12 cannot flow to atmosphere through the vent passageway formed by the slit 64, the slit 60 and the counterbore 62.

Another feature illustrated more clearly in FIG. 4 is an alignment pin 66 which is pressed into the valve body 30 and extends into a slot 68 formed in the valve member 44. The pin 66 and slot 68 cooperate to assure that the valve member 44 will not rotate relative to the valve body member 30, thereby maintaining the slits 56 in the valve member 44 in proper relationship to the slits 58 in the valve 30.

Figure 5:
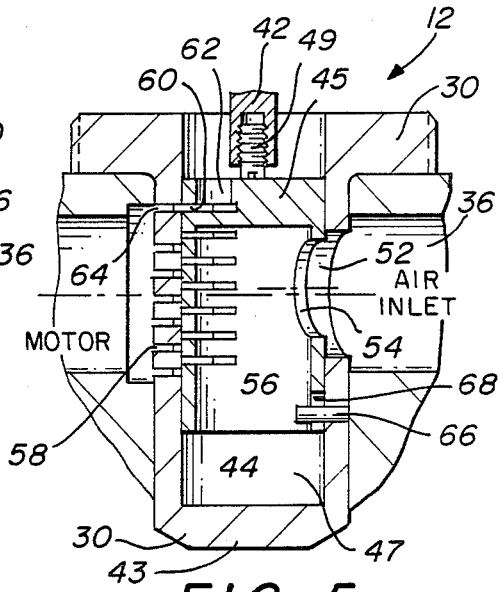
FIG. 5 is a view similar to FIG. 3 but showing the valve in the closed position.

As illustrated in FIG. 5, the valve 12 is in the closed position. That is, the outlet slits 56 in the valve member 44 are not in alignment with the slits 58 formed in the valve body 30. Accordingly, air cannot flow from the interior or chamber in the valve 12 into the passageway 36 downstream of the valve 12. It will be noted therein that when the valve 12 is in the closed position, the vent slit 64 is in alignment with the slit 60 and the counterbore 62 in the valve member 44, thus venting any pressure contained in the passageway 36 downstream of the valve 12 to atmosphere.

It should also be pointed out that in all positions, that is in both the closed and the open position of the valve 12, the inlet ports 52 and 54 remain in substantial alignment so that pressurized air flowing into the valve 12 will continue to flow into the chamber 47 thereof.

OPERATION OF THE PREFERRED EMBODIMENT

In operation, pressurized air is supplied to the nut runner 10 through the fitting 22. At this stage of the operation, little or no pressure is present in the chamber 47 of the valve 12 since the manual valve 26 is in the closed position. An appropriate tool (not shown) is attached to the square drive 16 and that placed upon the fitting to be secured.

Depressing the lever 24 opens the manual valve 26 through the manual valve plunger permitting air to flow through the passageway 36 to the valve 12. The computer has signaled the solenoid actuated valve 12 to begin operation and a condition signal has been transmitted over the conductors 46 and 48 energizing the coil 40 of the solenoid 27 causing the core 42 thereof to move the valve member 44 toward the open position illustrated in FIGS. 2 and 4 before the manual valve 26 is opened. As soon as the valve member 44 has reached this position and the manual valve 26 is opened, air flows through the passageway 36, through the valve 12 and through the motor, rotating the square drive 16.

When the nut runner 10 reaches a predetermined torque level, a condition signal is transmitted to the valve 12 shutting off the power supply to the coil 40 of the solenoid 27. When this occurs, the pressure in the chamber 47 of the valve 12 starts the valve member 44 moving upwardly. The valve member 44 is restrained at this point by the solenoid 27 since the magnetic flux developed by the coil 40 has not dissipated. To remove the restraint, the field suppressor 60 automatically actuates to rapidly break the magnetic flux down, and thus decrease the time required for valve closure. The pressure in the chamber 47 is then able to rapidly drive the valve member 44 upwardly into the closed position illustrated in FIG. 5.

It must be emphasized that since the solenoid 27 has sufficient power to hold the valve member 44 in the open position against the force imposed by the pressurized air, it has sufficient force to prevent or retard movement of the valve member 44 toward the closed position until such time as the reduction of the flux strength occurs. The use of the field suppressor accelerates this process so that the shut-off valve 12 has an extremely fast response time in moving the 0.050 inches required from the open to the closed position. Due to such fast response time, that is, the time for movement of the valve member 44 between the open and closed positions, the torque imposed by the nut runner 10 will be consistently maintained at the desired level.

From the foregoing, it will be appreciated that the valve described hereinbefore is relatively simple in construction, easy to maintain, and provides for the very rapid movement of the valve member from the open to closed position due to the use of air pressure to move the valve member and further due to the use of the field suppressor.

It will also be understood that the single embodiment described is presented by way of example only and that many changes and modifications can be made thereto without departing from the spirit or scope of the invention.

What is claimed is:

1. A fast response shutt-off valve for pneumatic tools and the like comprising:

a generally cylindrical, hollow body member having a closed end and having an inlet and an outlet;

a generally cylindrical, hollow valve member having an interior and located for reciprocating movement in said body member between open and closed positions, said valve member having an inlet port in fluid communication with the inlet in said body member and with the interior of said valve member in both said positions and an outlet aligned with and in fluid communication with the outlet in said body member in said open position of said valve member and misaligned with the outlet in said body member preventing fluid communication therebetween when said valve member in said closed position, said valve member having a closed end cooperating with the closed end of said body member to form a variable volume chamber in said valve, said valve member being biased by fluid in said body member toward the closed position for rapid movement of said valve member from the open to the closed position by said fluid, said valve member also including a vent passageway for connecting a portion of said outlet in said body member to atmosphere when said valve member is in the closed position;

releasable mean for releasably holding said valve member in the open position, said releasable means including an electrically-actuated solenoid mounted in fixed relationship to said body member and connected with said valve member for positioning said valve member;

field suppression means connected to said solenoid for decreasing the time required to flux breakdown when said solenoid is deenergized thereby permitting the valve member to move more rapidly from the open to the closed position; and, alignment means for preventing relative rotation between said valve member and said body member while permitting relative reciprocating movement therebetween.

2. A fast response shut-off valve for pneumatic tools and the like comprising:

a hollow body member having a pressurized fluid inlet port and outlet port and a closed end;

a generally cylindrical, hollow valve member located for reciprocating movement between a first position permitting pressurized fluid flow through said ports, and a second position preventing pressurized fluid flow through said ports, the closed end of said body member and the closed end of said valve member forming a variable volume chamber in said pressurized fluid flow path, said valve member having an inlet in fluid communication with an inlet port in said body member and an outlet aligned with and in fluid communication with the outlet port of said body member, said valve member being biased by the pressurized fluid in said variable volume chamber toward the second position;

releasable means for releasably holding said valve in the first position whereby upon said releasable means releasing said valve member, said pressurized fluid in said chamber rapidly moves said valve member from said first to said second position, said releasable means including an electrically-actuated solenoid mounted in fixed relationship to said body member and connected to said valve member for positioning said valve member;

field suppression means connected to said solenoid for decreasing the time required for flux breakdown when said solenoid is deenergized thereby permitting the valve member to move more rapidly from the first to the second position; and, alignment means for preventing relative rotation between said valve member and body member while permitting relative reciprocating movement therebetween.

* * * * *